US005376237A

United States Patent [19]

Ishiguro et al.

[11] Patent Number: 5,376,237

[45] Date of Patent: Dec. 27, 1994

[54] NEWSPRINT

[75] Inventors: Takeshi Ishiguro, Tokyo; Toshifumi Nishikubo, Ishinomaki; Ippei Shimizu, Tokyo, all of Japan

[73] Assignee: Jujo Paper Co., Ltd., Tokyo, Japan

[21] Appl. No.: 979,401

[22] Filed: Nov. 19, 1992

Related U.S. Application Data

[63] Continuation of Ser. No. 451,585, Dec. 18, 1989, abandoned.

[30] Foreign Application Priority Data

Dec. 22, 1988 [JP] Japan ..... 63-321984

[51] Int. Cl.[5] ..... D21H 19/38

[52] U.S. Cl. ..... 162/134; 162/135; 162/142; 162/150; 162/181.2; 162/181.3; 162/181.5

[58] Field of Search ..... 162/135, 142, 150, 181.1, 162/181.2, 181.3, 181.6, 181.8, 134, 181.5; 106/23, 463, 464, 468, 469

[56] References Cited

U.S. PATENT DOCUMENTS

| | | | |
|---|---|---|---|
| 2,641,557 | 6/1953 | Green | 162/181.8 |
| 3,484,260 | 12/1969 | Emslie et al. | 162/181.2 |
| 3,798,047 | 3/1974 | Delfosse | 106/464 |
| 4,867,844 | 9/1989 | Dessauer | 162/135 |

FOREIGN PATENT DOCUMENTS

| | | | |
|---|---|---|---|
| 59-43197 | 3/1984 | Japan | 162/181.6 |
| 59-112097 | 6/1984 | Japan | 162/181.6 |
| 60-22000 | 2/1985 | Japan | 162/181.6 |
| 61-70098 | 4/1986 | Japan | 162/181.8 |
| 1174697 | 7/1989 | Japan . | |
| 572548 | 9/1977 | U.S.S.R. | 162/181.2 |

*Primary Examiner*—Peter Chin

*Attorney, Agent, or Firm*—Sherman and Shalloway

[57] ABSTRACT

Multicolor printing on a high speed web-fed press with cold-set ink increases production efficiency over that of a press with dryers. For this purpose, newsprint is used because of its good oil absorptiveness, however, the printing quality is not satisfactory. A coating including needle form pigments, the average oil absorptiveness of which is more than 65 cc/100 g, was applied on the base paper, and coated paper for the high speed press was produced. The present invention increases the reproducibility of dots and sharpness of print patterns compared comparing to usual newsprint without decreasing the handling efficiencies

8 Claims, No Drawings

NEWSPRINT

This application is a continuation, of application Ser. No. 07/451,585, filed Dec. 18, 1989, now abandoned.

BACKGROUND OF THE INVENTION

1. Field of the Invention

This invention relates to a newsprint, in particularly to a newsprint which is suitable to the multicolor news printing on high speed newspaper presses with cold-set ink.

2. Prior Art

Recently, printing speed is rapidly increasing and the percentage of multicolor printing is also increasing in accordance with the development of several technologies. This tendency is now also common for news printing. However, the multicolor news printing must be performed in the usual conditions, namely, on the high speed presses using common newsprint and penetration type cold-set ink because of its needs for mass production and printing cost.

However, the printability of the conventional method mentioned above, especially the color and tile sharpness, has been very poor compared to that of coated paper, and has had less impact on the human eye. Accordingly, the conventional method can not be applied to color pages or multicolor leaflet because they need good printing appearance. Usually, other printing methods are used for such purposes.

Several method for the better printing quality have been suggested. One of these methods is the use of heat-set ink instead of cold-set ink. In this case, the printing is performed on presses equipped with dryers using heat-set ink and newsprint. However, cost for equipment and printing is relatively high. Alternative method is the combination of cold-set ink, high grade papers and the high speed newspaper press without dryers. When usual coated paper, such as woodfree or wood containing based, is used, it is impossible to get satisfactory results except at low printing speed because the cold-set ink is not dried at high speed on the press without dryers.

Secondly, clear coating of paper is popular for the improvement of the paper printability. In this case, solution of sizing agents or high molecular materials without pigment are coated on the base paper with conventional coaters such as the size press. However, it is also impossible to get good printing performance on the press using cold-set ink because the ink absorptiveness of the paper decreases with increasing sizing degree.

Thirdly, uncoated paper such as fine paper is thought to give a better result than newsprint. However, even if the sizing degree of tile fine paper is same as that of newsprint, the difference of the printability between the fine paper and newsprint is limited to the better reproducibility and contrast for monochrome parts. And, the color reproducibility and sharpness of the mixed color does not improve. When the calendered fine paper is used to obtain the print gloss, the printing speed must be set at lower level because of its poor ink set problems.

Pigment coated or clear coated newsprint shows the same tendencies like common coated papers as described above because the surface properties were mainly decided by the coating layer, and the results of the multicolor printing using coated newsprint and cold-set ink on the high speed presses were not satisfactory. As mentioned above, there is not a kind of paper with which a sufficient printing speed and good multicolor printing can be obtained. Additionally, it is impossible to achieve the desired results with the conventional technologies or the mixture of conventional technologies. Accordingly, a new kind of paper has been strongly desired.

SUMMARY OF THE INVENTION

The purpose of this invention is to produce a kind of paper with which the same level of sharpness and reproducibility as coated paper can be obtained, while maintaining the level of necessary properties, such as immediate ink setting, surface strength, opacity, and folding quality to those, of newsprint.

DETAILED DESCRIPTION OF THE INVENTION

The invention 62-333938 by inventors of present invention is to achieve the purpose described above. The invention mentioned the use of coated newsprint, the coating layer of that contains pigments whose absorptiveness is more than 65 cc/100 g. As we continued the study we found that the object of the present invention can be attained by using a base stock mainly composed of mechanical pulp, and a coating layer comprising needle from pigment wherein an average oil absorptiveness of the whole pigment in said coating layer is more than 65 cc/100 g.

The base paper used for this invention was 40–52 $g/m^2$ mechanical pulp based paper and contains usual fillers, a small amount of water soluble high molecular retention agents as needed. This base paper must satisfy the properties which are necessary for the printing with cold-set ink on high speed press, in other words, physical properties such as tensile strength, tear strength and elongation should be at the same level as usual newsprint.

The mechanical pulp includes, for example, ground wood pulp, thermomechanical pulp, semichemical pulp, recycled mechanical pulps produced by deinking of newspaper or magazines containing these pulps, and broke in paper making. These pulps can be used as single form or mixed form at desirable ratios. A small amount of chemical pulp can be added for the adjustment of the optical properties in the range it does not decreases the physical properties of mechanical pulps.

Known pigments can be used as the filler. For example, clay, talc, titanium dioxide, white carbon, calcium carbonates and urea resin fine particles can be used. The preferable amount of these materials is usually from 0.5 to 10%. If the amount is far less than 0.5%, it causes poor opacity or oil absorptiveness. On the other hand, if the amount is far more than 10%, tensile strength or tear strength tend to decrease.

The needle shape pigments contained in the coating layer means pigments wherein the ratio of the length to width is at least 3 to 1, preferably at least 5 to 1. Single pigment or mixed pigments can be used. In the case where the needle shape pigments are mixed with pigments other than needle shape ones, it is preferable to use more than 20 weight percent, more preferable 30 weight percent needle shape pigments.

The average oil absorptiveness of all pigments in coating layer must be more than 65 cc/100 g, preferably from 75 cc/100 g to 150 cc/100 g. In the case where the oil absorptiveness is less than 65 cc/100 g, the high speed printing using cold-set ink is impossible because the set-off of the ink occurs. When the oil absorptiveness is more than 150 cc/100 g, the fluidity of the coating color tend to decrease and it causes problems on the coaters such as the blade coater or the gate roll coater. Pigment formulations with single pigment or mixed pigments can be used. In the case pigments whose oil absorptiveness is less than 65 cc/100 g and pigments whose oil absorptiveness is more than 65 cc/100 g are mixed, the formulations should be designed in order to achieve that the average oil absorptiveness is more than 65 cc/100 g and the amount of the pigments whose oil absorptiveness is more than 65 cc/100 g is more than 15 weight percent, preferable more than 20 weight percent. When the parts of the high oil absorptiveness pigments is less than 15 weight percent, set-off and/or rub-off could partially occur. Here, the rub-off means the phenomena that printed ink drops out in multi-printed parts because of inadequate drying of the ink.

The pigments which can be used are, for example, various kinds of silicon dioxide, activated clay, calcined clay, fine magnesium carbonate, various kinds of silicate, diatomaceous earth, urea resin powder as representatives of those with high oil absorptiveness, and kaolin, talc, various kinds of calcium carbonate, titanium dioxide, zinc white as representatives of those with low oil absorptiveness. The pigments with low oil absorptiveness, in this case, are not used alone, instead, they are used as mixtures with the pigment with high oil absorptiveness. The main reason for the use of the low oil absorptiveness pigments is the control of the coating color properties because the coating properties of high oil absorptiveness pigments are generally poor. The needle shape pigments are, for example, satin white, needle form precipitated calcium carbonate, and Hongkong kaolin, and the oil absorptiveness of those pigments are in a wide range. These pigments are mixed with binders and applied on the base paper as the coating color. Binders, for example, styrene butadiene latex, starch and starch derivatives, polyvinyl alcohol and cellulose derivatives are commonly used, however, the invention is not so, and several binders which are used as binders for paper making can be used, alone or in mixed form. It is important to decide the kinds and formulation parts of binders in order to obtain necessary surface strength at minimum amount and not to decrease the absorptiveness of the pigments. For this purpose, polyvinyl alcohol and styrene butadiene latex are suitable.

There is not any problems to add additives used commonly when preparing coating colors, such as insolubilizers, dispersants and lubricants, to the coating colors composed with pigments and binders.

All kinds of coaters used commonly in the paper industry, such as gate roll coater, blade coater, and air knife coater can be used. On machine coater is suitable from the view point of the production cost.

One side or two sides of the base paper are coated on the coater. In the case where two sides are printed, then both sides must be coated. In the case where one side is printed, the coated side should be printed. Even if only one side is printed, sometimes, the other side is slightly coated in order to decrease the difference of paper between both sides. The handling in the printing and storing gets better with a decreasing difference between the two sides.

The coat weight of the printed side is usually from 1 to 12 g/m2, preferably from 3 to 8 g/m$^2$, and total basis weight including the base stock is preferably less than 60 g/m$^2$. When the coat weight is less than 1 g/m$^2$, the print appearance is occasionally poor. On the other hand, when the coat weight is more than 12 g/m$^2$, the stiffness tends to be less than the level required for newsprint.

According to the printing quality, smoothing treatment such as supercalendering and/or machine calendering for the newsprint produced by the method mentioned above can take place. However, excess smoothing treatment is not preferable because it causes the decrease of brightness, ink setting and paper strength. Especially, the decrease of stiffness sometimes causes the problems on the folders.

In the case where the newsprint produced by the method of this invention, namely, the mechanical pulp based newsprint with coated layer which contains needle form pigments and the average oil absorptiveness is more than 65 cc/100 g, is printed on the high speed press using cold-set ink, the ink is immediately absorbed and/or adsorbed. The part of ink which is not absorbed or adsorbed by the pigments reaches to the mechanical pulp based base paper. Because the base paper has the same level of oil absorptiveness as usual news print, the total oil absorptiveness is extremely high and the ink is absorbed and/or adsorbed very rapidly. Accordingly, the multicolor printing can be performed at high speed.

Kaolin clay, the crystal form of which is rhombohexagonal (hexagonal plate), is usually used as a major pigment for the coating layer of common coated paper. Because of the crystal form of kaolin clay, kaolin particles have tendency to be in the parallel orientation under the smoothing treatment, and to give a highly glossy surface. However, in the where the high speed printing using cold-set ink is performed on such a coating layer, the ink does not immediately penetrate into the coating layer, and the set-off occurs.

Additionally, if multicolor printing is performed, every color ink flows onto the surface of the coating layer because ink penetration into the coating layer is slow, and finally ink mixture occurs. Accordingly, the reproducibility of color is poor.

On the other hand, when the pigments with high oil absorptiveness mentioned in this invention are used, ink is immediately set in the coating layer and the flow toward the coating layer is less. Accordingly, the reproducibility of color is good because every color is independently set. Further more, when needle form pigments are contained in the pigment formulations, the average oil absorptiveness is more than 65 cc/100 g, the coating layer becomes smoother, the sheet gloss and print gloss become as high as those of usual coated paper. As the result, every color in the multicolor printing can be clearly identified, and reproducibility and sharpness of color are at the level required for the usual commercial multicolor printing.

EXAMPLES

The present invention is described by the examples. However, these examples are intended to illustrate the invention, and the present invention is not limited to these examples. The ways of measurement which evaluate the several properties in these examples are described.

(1) Oil absorptiveness of pigments.

According to JIS K5101. When this measurement is applied to the mixture of pigments, these pigments must be well mixed, previously.

When the pigment is ill a slurry form, sample slurry of from 1 to 10 g as dry base is diluted with pure water, then, pour the diluted slurry on the glass plate (area of about 1 $m^2$) with side banks, then seal the plate not to be contaminated, then dry it at 20 degree centigrade at 60% relative humidity, then dried powder is scraped off for the measurement sample.

(2) Bekk smoothness.

The smoothness of base paper and coated paper is measured according to JIS P8119.

(3) Surface strength of coating layer.

Evaluated by the blanket scum on the high speed web-fed offset press (Koebau BB type by Sumitomo Heavy Industry Co. Ltd.) after a 1000 m printing run at the printing speed of 500 m/min.

The standard level of the blanket scum is that of usual newsprint at the same conditions. The level is evaluated as good (less blanket scum than standard), fair (same level blanket scum comparing to standard), and poor (more blanket scum than standard).

(4) Setting of ink.

Just after the printing run at the same conditions described in (3), three sheets at around 500 m point from the starting point are collected, then overlapped with fine paper sheets, keep a 50 g/$cm^2$ weight continuously for 1 hour to the overlapped sheets, then evaluate the degree of set-off on the surface of the fine paper by eye.

The standard level of the set-off is that of usual newsprint. The level is evaluated as good (less set-off than standard), fair (same level set-off to standard), and poor (more set-off than standard).

(5) Ink density.

Solid density of the printing test pattern is measured with Macbeth densitometer (made by Kollmogen Corporation). The sufficient level is more than 1.30, and the level is poor if the readings are less than 1.20.

(6) Brightness.

The brightness of sheets is measured with Hunter brightness tester (made by Toyo Seiki Co. Ltd. ).

(7) Gloss.

The sheet gloss and the print gloss are measured with 75 degree gloss meter (made by Murakami Shikisai Kenkyusyo).

(8) Reproducibility of dots.

Evaluate size, shape and condition of overlapping of dots by eye with an amplifier. The level of usual newsprint is poor, better than newsprint is fair. When the copy is almost perfectly reproduced on the sample, the level is good.

Sharp and good color reproducibility can be obtained and the printed sheet has strong impact when the ink density is high, the reproducibility of dots is good, and the brightness of the sheet is high.

(9) Rub-off of ink.

Just after the printing, rub softly the surface of the printed part with fingers, then evaluate the degree of the ink rubbed off. The level of usual newsprint is good, more contamination is the fair level. The poor level is contamination more than the fair level. The poor operation is not useful in the commercial level.

In the examples and comparative examples below, parts represents solid weight parts, percent (%) represents weight percent, respectively.

Comparative Example 1

50 parts of ground wood pulp, 30 parts of recycled pulp from deinked newspaper, and 20 parts of kraft pulp were mixed and refined to the canadian standard freeness of 200 ml. With the mixed and refined pulp described above, the base paper A was produced on a Bel-Baie former type paper machine at the speed of 960 m/min. The basis weight, brightness, smoothness and density of the base paper was 46 g/$m^2$, 51%, 60 sec, and 0.65, respectively, and these values were at standard level of usual newsprint.

EXAMPLE 1

30 parts of satin white (SW-BL by Shiraisi Karusyumu Co. Ltd. oil absorptiveness 100 cc/100 g), 40 parts of calcined clay (oil absorptiveness 90 cc/100 g), and 30 parts of No.2 clay (oil absorptiveness 45 cc/100 g) were added to water containing a dispersant (Aron T-40 by Toagousei Co. Ltd. 40% concentration), then pigment slurry was prepared by mixing with agitation. The oil absorptiveness of the mixed pigment described above was 80 cc/100 g.

Then, 25 parts of styrene butadiene latex and 15 parts of oxidized starch were added to the slurry with agitation, mixed well, and a 45% coating color was prepared.

This coating color was applied on the two sides of the base paper A on a blade coater, and newsprint B1 was produced. The coat weight for the each side of newsprint B1 was 5 g/$m^2$ (oven dry), totally 10 g/$m^2$ for the both sides. Bekk smoothness of the coating layer was 45 sec.

Then this paper was supercalendered on a supercalender (by Ishikawazinma Heavy Industry Co. Ltd.) at 60 degree centigrade at the line pressure of 100 kg/cm, and newsprint C1 was produced. Bekk smoothness of newsprint C1 was 100 sec.

Printing was performed on a high speed web-fed press (Koebau BB type by Sumitomo Heavy Industry Co. Ltd) with these papers at the printing speed of 500 m/min. Cold-set inks of cyan and magenta for newsprint (Newswebmaster, Purosesubeni M, Purosesuai M by Sakata Syokai) were used for the printing.

Results of handling and printing quality are shown in Table 1.

EXAMPLE 2

A needle form precipitated calcium carbonate was used as a needle form pigment. A 30% pigment slurry was prepared using a formulation described below by the same way described in example 1. Prepared coating color was applied on an air knife coater on the base paper A produced in comparative example 1, and newsprint B2 was produced. The coat weight for the each side was 5 g/$m^2$.

| | |
|---|---|
| Calcined clay (oil absorptiveness 95 cc/100 g) | 50 parts |
| Synthetic Silica (oil absorptiveness 290 cc/100 g) | 10 parts |
| Needle form precipitated calcium carbonate (oil absorptiveness 53 cc/100 g) | 20 parts |
| Super fine ground calcium carbonate (oil absorptiveness 30 cc/100 g) | |
| Dispersant (sodium pyrophosphate) | 0.5 parts |
| Styrene butadiene latex | 15 parts |
| Polyvinyl alcohol | 10 parts |

The oil absorptiveness of the mixed pigments was 95 cc/100 g. Smoothness of the coating layer was 42 sec. Newsprint B2 was supercalendered and newsprint C2, the smoothness of which was 110 sec, was produced.

Printing test was performed with these newsprints. Results are also shown in Table 1.

EXAMPLE 3

Satin white was used as a needle form pigment. The formulation of example 1 was modified as described below, and 45% slurry was used. Newsprint B3, smoothness of which was 43 sec, was produced by the same way described in example 1. Newsprint C3, smoothness of which was 120 sec, was produced by supercalendering. The results of the printing test are shown in Table 1.

| | |
|---|---|
| Satin white (SW-BL by Shiraishi Karusyumu Co., Ltd., oil absorptiveness 100 cc/100 g) | 10 parts |
| No. 2 Kaolin | 15 parts |
| Calcined clay | 75 parts |
| Styrene butadiene latex | 5 parts |
| Oxidized starch | 6 parts |
| Dispersant | 0.5 parts |

The oil absorptiveness of No.2 kaolin and calcined clay were 42 cc/100 g and 90 cc/100 g, respectively, and that of the mixed pigments was 85 cc/100 g.

Comparative Example 2

A 35% pigment slurry was prepared using a formulation described below in the same way described in example 1. The coating color was applied on an air knife coater on the newsprint A produced in comparative Example 1. The coat weight for each side was 5 g/m$^2$, and newsprint B4, smoothness of which was 42 sec, was produced.

| | |
|---|---|
| Calcined clay | 80 parts |
| Super fine ground calcium carbonate | 20 parts |
| Dispersants (Sodium pyrophosphate) | 0.5 parts |
| Styrene butadiene latex | 10 parts |
| Polyvinyl alcohol | 10 parts |

The oil absorptiveness of calcined clay and supper fine ground calcium carbonate were 95 cc/100 g and 30 cc/100 g, respectively. That of the mixed pigments was 75 cc/100 g.

Newsprint, smoothness of which was 100 sec, was produced by supercalendering. The results of printing are shown in Table 1.

TABLE 1

| | Papers | Parts of Needle form pigments (weight %) | Oil absorptiveness (cc/100 g) | Smoothness (sec) | Surface Strength | Setting of ink | Brightness (%) | Print Gloss (%) | Ink density | Reproducibility of dots | Rub-off |
|---|---|---|---|---|---|---|---|---|---|---|---|
| Comparative Example | Base Paper A | | | 60 | good | good | 50.7 | 10 | 1.10 | poor | good |
| | B4 | 0 | 75 | 42 | good | good | 64.9 | 13 | 1.28 | good | good |
| Example | B3 | 10 | 85 | 43 | good | good | 65.1 | 20 | 1.33 | good | good |
| | B2 | 20 | 95 | 42 | good | good | 65.3 | 21 | 1.34 | good | good |
| | B1 | 30 | 80 | 45 | good | good | 64.8 | 23 | 1.36 | good | good |
| Comparative Example | C4 | 0 | 75 | 100 | good | good | 64.4 | 31 | 1.31 | good | good |
| Example | C3 | 10 | 85 | 120 | good | good | 64.9 | 40 | 1.37 | good | good |
| | C2 | 20 | 95 | 110 | good | good | 65.0 | 42 | 1.38 | good | good |
| | C1 | 30 | 80 | 100 | good | good | 64.6 | 44 | 1.41 | good | good |

As shown in Table 1, it is apparent that the brightness and the print gloss of newsprint A were in a lower level, and its reproducibility of color was not satisfactory because of its poor reproducibility of dots. Accordingly, newsprint A was not suitable for the commercial multicolor printing. Newsprints which had coating layer including needle form pigments in several examples showed higher print gloss regardless of their smoothness than coated papers B4, C4 whose coating layer did not include the needle form pigments and the oil absorptiveness of those was 75 cc/100 g as described in comparative example 2. Additionally, newsprints in examples showed excellent surface strength, setting of ink, brightness, ink density, reproducibility of dots, and rub-off, and were suitable for the high speed multicolor printing on high speed web-fed press using cold-set ink.

We claim:

1. Newsprint for a newspaper press using cold-set ink, said newsprint comprising a base stock mainly composed of mechanical pulp as a pulp material, and a coating layer containing a pigment composition coated on both sides of said base stock in an amount of 1 to 12 g/m$^2$, said pigment composition comprising at least one needle form pigment selected from the group consisting of satin white and needle form precipitated calcium carbonate in an amount of more than 20% by weight based on the total amount of pigment in said pigment composition and said pigment composition having an average oil absorptiveness of more than from 65 cc/100 g to about 150 cc/100 g.

2. The newsprint according to claim 1, wherein said mechanical pulp is at least one pulp selected from the group consisting of ground wood pulp, thermomechanical pulp, semichemical pulp, recycled mechanical pulps produced by deinking of newspaper or magazines containing these pulps, and broke in paper making.

3. The newsprint according to claim 1, wherein said needle form pigment has a length to width ratio of at least 3 to 1.

4. The newsprint according to claim 1, wherein said newsprint has a total basis weight including said base stock of less than 60 g/m$^2$.

5. In a method for multi-colored newsprinting using a high speed press and penetration type cold-set ink, the improvement comprising printing on a high speed press a newsprint comprising a base stock composed mainly of mechanical pulp and having a coating layer coated on both sides, in an amount of 1 to 12 g/m$^2$, said coating layer comprising at least one needle from pigment selected from the group consisting of satin white and needle form precipitated calcium carbonate in an amount of more than 20% by weight based on the total amount of pigment in said composition wherein said composition has an average oil absorptiveness of more than from 65 cc/100 g to about 150 cc/100 g with a penetration type cold-set ink.

6. The method of claim 5 wherein the needle form pigment has a length to width ratio of at least 3 to 1.

7. The method of claim 5 wherein the mechanical pulp is at least one selected from the group consisting of ground wood pulp, thermomemchanical pulp semi-chemical pulp, and recycled mechanical pulp produced by de-inking of newspapers and magazines containing the pulps.

8. The method of claim 5 wherein said newsprint has a total basis weight including the base stock of less than 60 $g/m^2$.

* * * * *